US005639260A

United States Patent [19]

McHugh

[11] Patent Number: 5,639,260

[45] Date of Patent: Jun. 17, 1997

[54] ELECTRICAL CONNECTOR FOR USE WITH FLEXIBLE PRINTED CIRCUIT

[75] Inventor: Robert G. McHugh, Evergreen, Colo.

[73] Assignee: Hon Hai Precision Ind. Co., Ltd., Taiwan

[21] Appl. No.: 533,705

[22] Filed: Sep. 26, 1995

[51] Int. Cl.[6] ..... H01R 9/07

[52] U.S. Cl. ..... 439/495; 439/260

[58] Field of Search ..... 439/495, 496, 439/260, 326, 67, 77, 259, 267, 159, 499, 630, 636, 329

[56] References Cited

U.S. PATENT DOCUMENTS

| | | | |
|---|---|---|---|
| 5,194,017 | 3/1993 | Consoli | 439/495 |
| 5,458,506 | 10/1995 | Yamaguchi | 439/495 |
| 5,474,468 | 12/1995 | Chishima et al. | 439/495 |
| 5,498,169 | 3/1996 | Ikemoto | 439/495 |

*Primary Examiner*—Neil Abrams
*Assistant Examiner*—Brian J. Biggi

[57] ABSTRACT

An electrical connector for use with flexible printed circuit (FPC) includes an elongated casing having an interior chamber defined by two side walls and a bottom and having a top opening. The chamber has a plurality of equally-spaced slots formed thereon to extend completely through the bottom of the casing and partially into the side walls to each receive therein a conductive terminal member which is in the form of a U shape, with the base of the U-shaped terminal member received within the bottom slot and the two arms of the U shape respectively received within side wall slots. Each of the arms has an inward projection formed on the free end thereof to contact and establish electrical engagement with the FPC. A driver member having a plate to be inserted into the chamber with a sufficient gap formed between the plate and the side walls of the chamber for receiving and retaining therein the FPC is provided to be rotatable and movable relative to the casing. The driver member is provided with two end cylinders to be respectively received and guided by chutes formed on two lengthwise ends of the casing for guiding the insertion of the driver member into the chamber. Releasable securing device is provided to secure the driver member, together with the FPC, within the chamber of the casing.

16 Claims, 4 Drawing Sheets

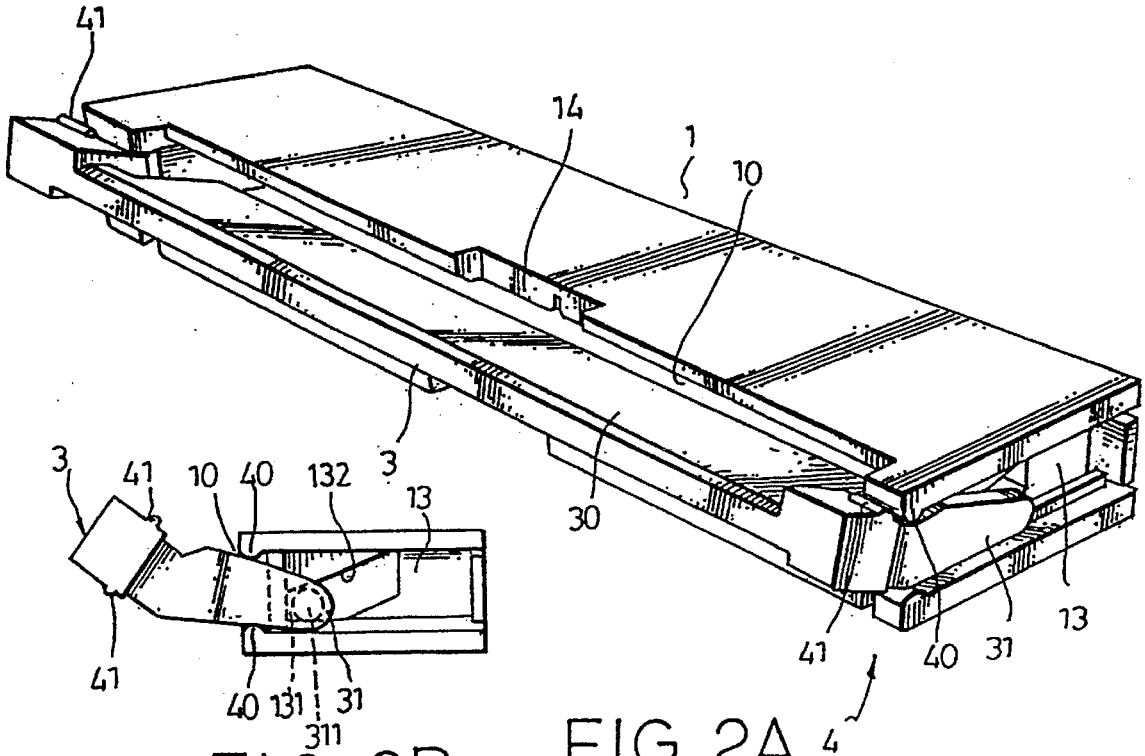
FIG. 2B
FIG. 2A
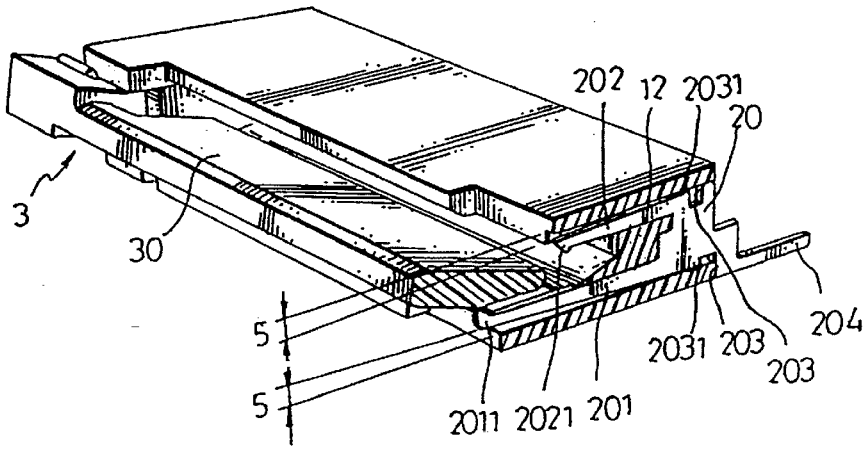
FIG. 3

ELECTRICAL CONNECTOR FOR USE WITH FLEXIBLE PRINTED CIRCUIT

FIELD OF THE INVENTION

The invention relates generally to an electrical connector and in particular to an electrical connector for use with a flexible printed circuit (FPC).

BACKGROUND OF THE INVENTION

FPC connectors, dependent upon the requirements in use, have a variety of different designs, such as those disclosed in U.S. Pat. Nos. 5,078,611, 4,808,113, 4,629,271, 4,684,183 and 3,989,336. All these patents disclose the electrical connector having an insulation casing defining an interior space in which conductive contact terminal members are received, the contact terminal members each having a resilient engaging arm having a contact provided thereon to contact and electrically connect to the FPC. A driver member is provided to move in a linear manner relative to the casing for bringing the FPC into the casing and securing the FPC within the casing to be in electrical engagement with the terminal members. Several disadvantages are found in these known designs of FPC connectors, such as:

(1) In the conventional designs, the driver member is forcibly inserted into the casing in a straight forward movement manner which causes abrasion occurring on the FPC by being contacted with the resilient arms of the contact terminal members. Further, in the conventional designs, a great force is required to overcome the biasing force provided by the resiliency of the arms of the contact terminal members in order to have the FPC move into engagement with the contact terminal members and such a great force may sometimes damage the FPC.

(2) The conventional designs provide resilient arms which act upon the FPC at only one side of the FPC so that a force imbalance occurs and it may result in undesired deformation of the FPC and/or the driver member and thus lead in bad contact engagement between the resilient arms and the FPC. To overcome such a problem, high manufacturing precision or tolerance is required in manufacturing the contact terminal members and this increases the manufacturing cost. Further, since the arms of the contact terminal member require resiliency to accommodate the insertion of the FPC, manufacturing tolerance to meet such strict requirement is critical during manufacturing such contact terminal member and this in turn increases the cost.

(3) In the conventional designs, hook-like retainers are provided on the driver member for securing the driver member to the casing. However, due to the minimization of the electrical connectors, the mechanical strength of the hook-like retainers is meritably decreased and this may cause the retainer to be easy to break during assembly. Further, such conventional retainers also require a great force to mount the driver member to the casing which more or less increases the time required in assembly process. Furthermore, besides the sense of the hands, there is no way for a manufacturing worker to check during the assembly process if the parts are moved to the desired position so that a misalignment or similar operation flaws may occur during assembly and thus result in a flaw product.

It is therefore desirable to provide an FPC connector structure which overcomes the above-mentioned problems.

OBJECTS AND SUMMARY OF THE INVENTION

An object of the present invention is to provide an FPC connector which comprises contact terminal members, each having two opposite resilient arms which, when simultaneously acting upon the driver member and the FPC, provide a balance of force acting upon the FPC and thus establishing a better electrical engagement between the contact terminal members and the FPC.

It is another object of the present invention to provide an FPC connector which comprises contact terminal members each with two opposite resilient arms, each contact terminal members having an inclined outer edge facing the side wall of the casing so as to form a gap therebetween which provides the capability of elastic deformation for the arms to accommodate the FPC inserted therebetween and thus less requirement of manufacturing tolerance may be imposed on the contact terminal members for providing suitable resiliency.

It is a further object of the present invention to provide an FPC connector wherein the driver member has camming cylinders received within and guided by corresponding chutes formed on the casing to guide the insertion of the driver member, together with the FPC, into the casing in such a manner that the driver member is first retained inclined relative to the casing to allow the FPC to enter the spacing between the driver member and the casing and the driver member is then rotated and moved under the guidance of the camming chutes to bring the FPC into the casing and form electrical engagement with the contact terminal members so as to reduce the abrasion of the FPC caused by the contact terminal members and thus protecting the FPC from being damaged by such abrasion.

To achieve the above objects, in accordance with the present invention, there is provided an electrical connector for use with FPC comprising an elongated casing having an interior chamber defined by two side walls and a bottom with a top opening. The chamber has a plurality of equally-spaced slots formed thereon to extend completely through the bottom of the casing and partially into the side walls to each receive therein a conductive terminal member which is in the form of a U shape, with the base of the U-shaped terminal member received within the corresponding bottom slot and the two arms of the U shape respectively received within the corresponding side wall slots. Each of the arms has an inward projection formed on the free end thereof to contact and establish electrical engagement with the FPC. A driver member having a plate to be inserted into the chamber with a sufficient gap formed between the plate and the side walls of the chamber for receiving and retaining the FPC therein is provided to be rotatable and movable relative to the casing. The driver member is provided with two end cylinders to be respectively received and guided by chutes formed on two lengthwise ends of the casing for guiding the insertion of the driver member into the chamber. Releasable securing device is provided to secure the driver member, together with the FPC, within the chamber of the casing.

BRIEF DESCRIPTION OF THE DRAWINGS

Other features and advantages of the present invention will become apparent in the following detailed description of preferred embodiments thereof, which are illustrative only and not limitative to the scope of the present invention, reference being had to the attached drawings, wherein:

FIG. 2A is a perspective view showing an electrical connector of the present invention in which the driver member is not securely retained within the casing;

FIG. 2B is a side view of the electrical connector of the present invention;

FIGS. 3 is a perspective view of a portion of the electrical connector of FIG. 2B, showing the inside structure thereof;

DETAILED DESCRIPTION OF THE PREFERRED EMBODIMENT

Figures 1A, 1B:
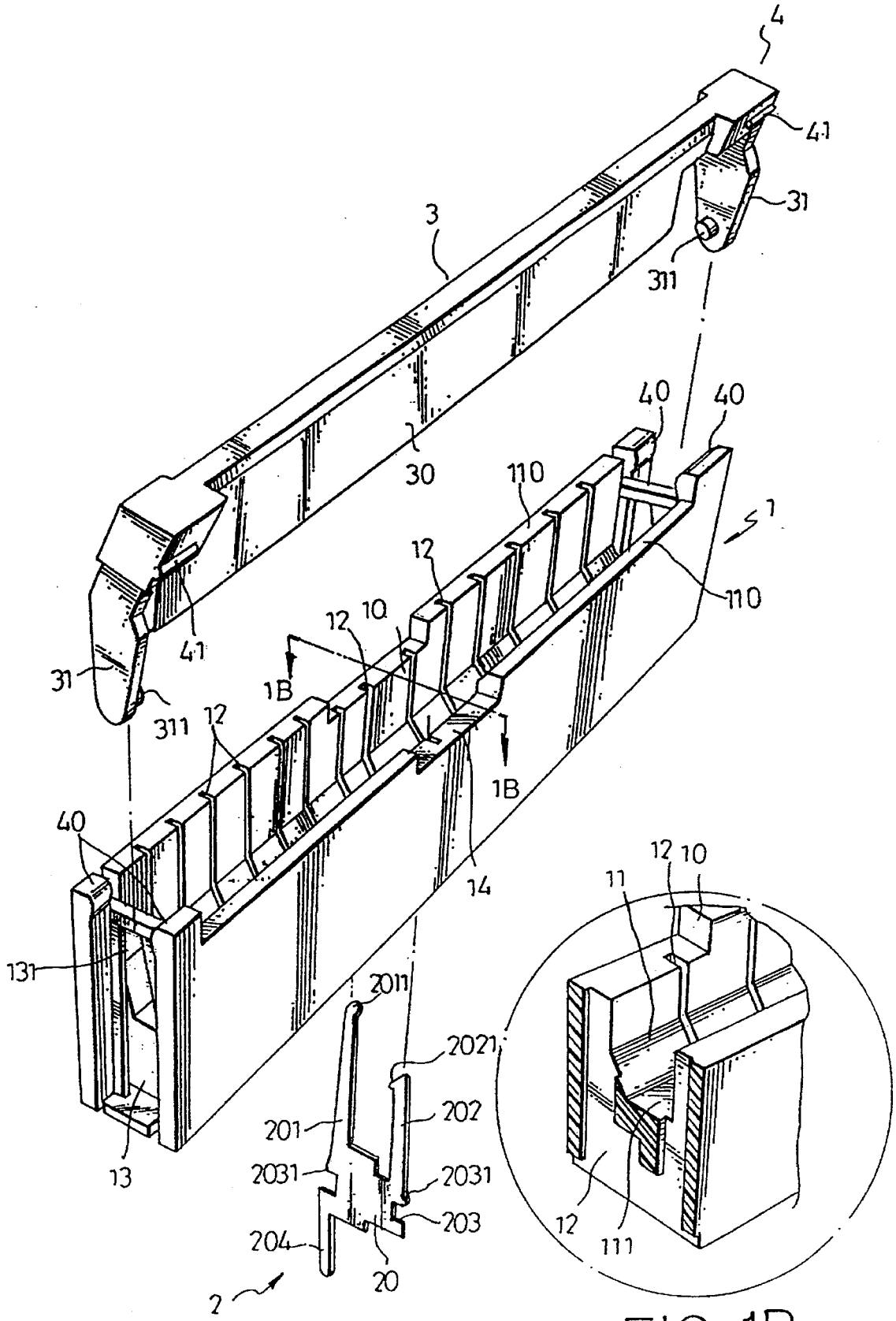
FIG. 1A is an exploded perspective view showing an electrical connector for use with FPC constructed in accordance with a first embodiment of the present invention.
FIG. 1B is a perspective view of a portion of the casing of the electrical connector of FIG. 1A, taken along line 1B—1B of FIG. 1A.

With reference to the drawings and in particular to FIG. 1A, wherein an electrical connector for use with flexible printed circuit (FPC) constructed in accordance with the present invention is shown, the electrical connector of the present invention comprises generally an elongated insulation casing 1, a plurality of conductive contact terminal members 2 received within the casing 1, driver means 3 for driving the FPC (not shown) into the casing 1 and in tight engagement with the terminal members 2 and securing means 4 for securing the driver means 3 within the casing 1.

The casing 1 has formed therein an interior chamber 11 defined by two opposite side walls 110 and a bottom 111 (see FIG. 1B) and having a top opening 10 formed on the top side of the casing 1, as viewed in FIG. 1A, for the entry of the terminal members 2. The chamber 11 has a plurality of slots 12 formed therein to be spaced along the length of the casing 1, preferably in an equally spaced manner, to each receive and retain therein one of the terminal members 2. Each of the slots 12 comprises a bottom section extending completely through the bottom 111 of the chamber 11 and two side sections each partially extending into each of the side walls 110.

On each of two opposite lengthwise ends of the casing 1, a chute 13 is formed and is configured so as to have a converging section 131 toward the opening 10 of the chamber 11, as best seen in FIG. 2B, defined by an inclined edge 132. Further, the casing 1 has a notch 14 formed on the top of one of the side walls 110 to serve as a window for observing and checking if the terminal members 2 are correctly located.

As shown in FIG. 1A, each of the terminal members 2 comprises a substantially U shape having a base 20 from which a first arm 201 and a second arm 202 extends. The two arms 201 and 202 are spaced from each other and extending along substantially the same direction, substantially normal to the length of the casing 1 so as to allow the two arms 201 and 202 to be received within the side sections of the respective slot 12 while the base 20 of the terminal member 2 inserted into the slot 12, as shown in FIG. 3.

Each of the terminal members 2 has formed on the base 20 thereof notches 203 at the connection between the arms 201, 202 and the base 20 to provide resiliency to the arms 201 and 202 to allow the arms 201 and 202 to be bent outward and away from each other.

Each of the arms 201 and 202 is provided with an inclined outer edge which is converged inward toward the free end thereof so as to leave a gap 5 between the arm 201 (202) and the corresponding side sections of the respective slot 12, as best seen in FIG. 3, such gaps 5, when cooperating with the notches 203, allows the arms 201 and 202 to be elastically bent outward to provide an increased spacing between the two arms 201 and 202.

Each of the terminal members 2 has at least one barb 2031, preferably two, formed on the base 20 thereof to engage an side walls 110 of the casing 1 for securely retaining the terminal member 2 within the corresponding slot 12 and communicative with the chamber 11 of the casing 1.

An external contact pin 204 is provided on the base 20 of each of the terminal members 2, which in the embodiment illustrated in FIG. 1A, extends substantially along a direction opposite to the arms 201 and 202.

Each of the arms 201 and 202 has a contact projection 2011 or 2021 formed on the free end thereof to be substantially flush with or slightly projecting out of the top of the side walls 110. Preferably, each of the contact projections 2011 and 2021 is provided with an inclination for guiding the insertion of the FPC into the chamber 11.

The driver means 3, as shown in FIG. 1A, comprises an elongated plate member 30, preferably having a converging lower end to be inserted into the chamber 11 through the opening 10. The plate 30 has such a thickness as to leave a gap between the plate 30 and the side walls 110 of the casing 1 when the plate 30 is inserted into the chamber 11 for receiving and sandwiching therebetween the FPC (not shown). The driver means 3 has formed on each of two opposite lengthwise ends an end member 31 to be substantially corresponding to one of the chutes 13 of the casing 1. Each of the end members 31 has an inward projected camming cylinder 311 to be received within and guided by the respective chute 13. This allows the driver means 3 to be movably secured on the casing 1. Also, the plate 30 of the driver means 3 is so dimensioned and configured as to be insertable into the chamber 11 of the casing 1 and since the converging sections 131 of the chutes 13 terminate at locations close to the opening 10 of the chamber 11, the plate 30 is allowed to inclined relative to the casing 1 and is rotatable about the camming cylinders 311 relative to the casing 1. The converging sections 131 of the chutes 13 serve to guide, due to engagement with the camming cylinders 311, the plate 30 into the chamber 11.

Figure 4:
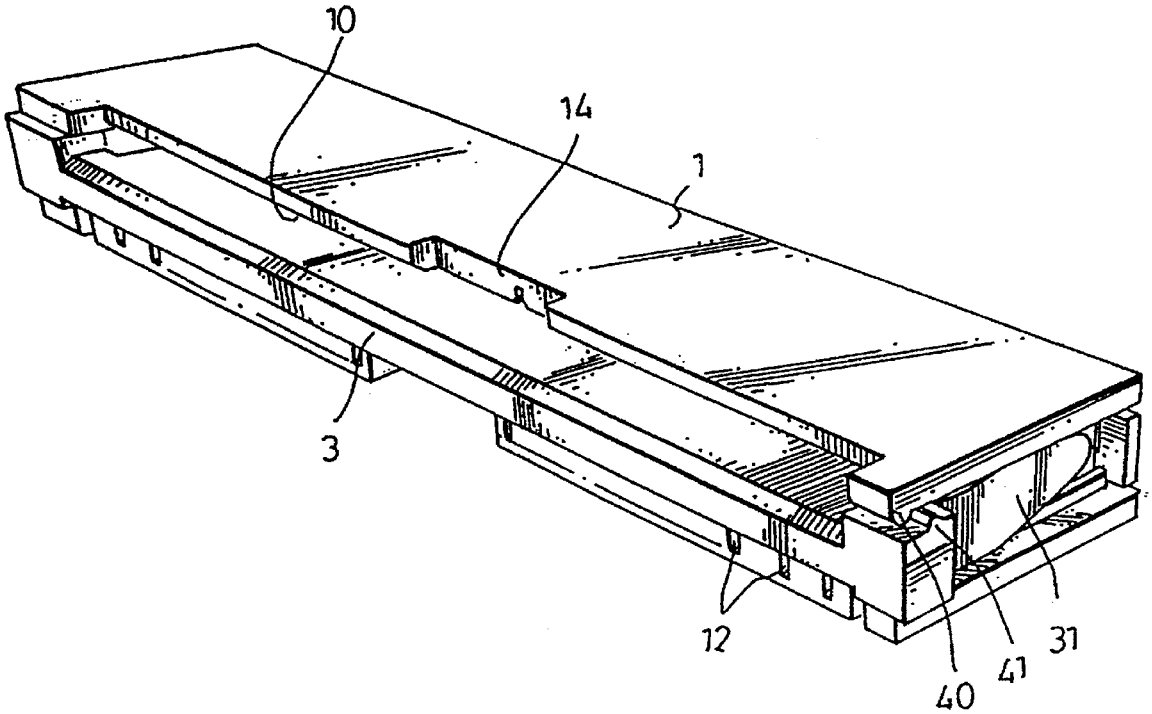
FIG. 4 is a perspective view showing a completely assembled electrical connector of the present invention.

The driver means 3 is provided with securing means 4 for securing the driver means 3 within the chamber 11 of the casing 1. The securing means 4 comprises raised ribs 41 formed on the driver means 3 to engage corresponding strips 40 formed inside the chamber 11 and preferably extending lengthwisely along the opening 10 thereof. The ribs 41 of the driver means 3 and the strips 40 of the casing 1 are configured and made of resilient material so that when the plate 30 of the driver means 3 is inserted into the chamber 11, the ribs 41 are brought into contact engagement with the strips 40 and may be forced to slide over the strips 40 so as to have the ribs 41 move into the chamber 11. The ribs 41 are then prevented from moving out of the chamber 11 by being stopped by the strips 40 so as to securely retain the driver means 3 on the casing 1 as shown in FIG. 4. Such a resilient engagement between the strips 40 and the ribs 41 provides a releasable securing engagement between the driver means 3 and the casing 1.

With particular reference to FIGS. 2A, 2B and 3, the chamber 11 of the casing 1, with the terminal members 2 appropriately received and retained within the slots 12, provides a space for receiving the FPC which is driven into the space by means of the driver 3 and retained within the space between one of the side walls 110 and the plate 30 of the driver means 3. The gap left between the plate 30 of the driver means 3 and the side walls 110 of the casing 1 is large to receive and retain the FPC therein.

In assembly, the end members 31 of the driver means 3, which are provided with resiliency, are bent outward to allow the camming cylinders 311 to be inserted into the chutes 13. The driver means 3, with the camming cylinders 311 received within the converging sections 131 of the chutes 13, is capable to be inclined relative to the casing 1, as shown in FIG. 2B, to leave a sufficient spacing between the plate 30 and the side wall 110 of the casing 1 for receiving the FPC. With the FPC received within the spacing between the plate 30 and the side wall 110, pushing the driver means 3 toward the bottom 111 of the chamber 11, with the camming cylinders 311 guided by the inclined edges 132 of the chutes 13, forces the FPC inward therewith.

Figure 6:
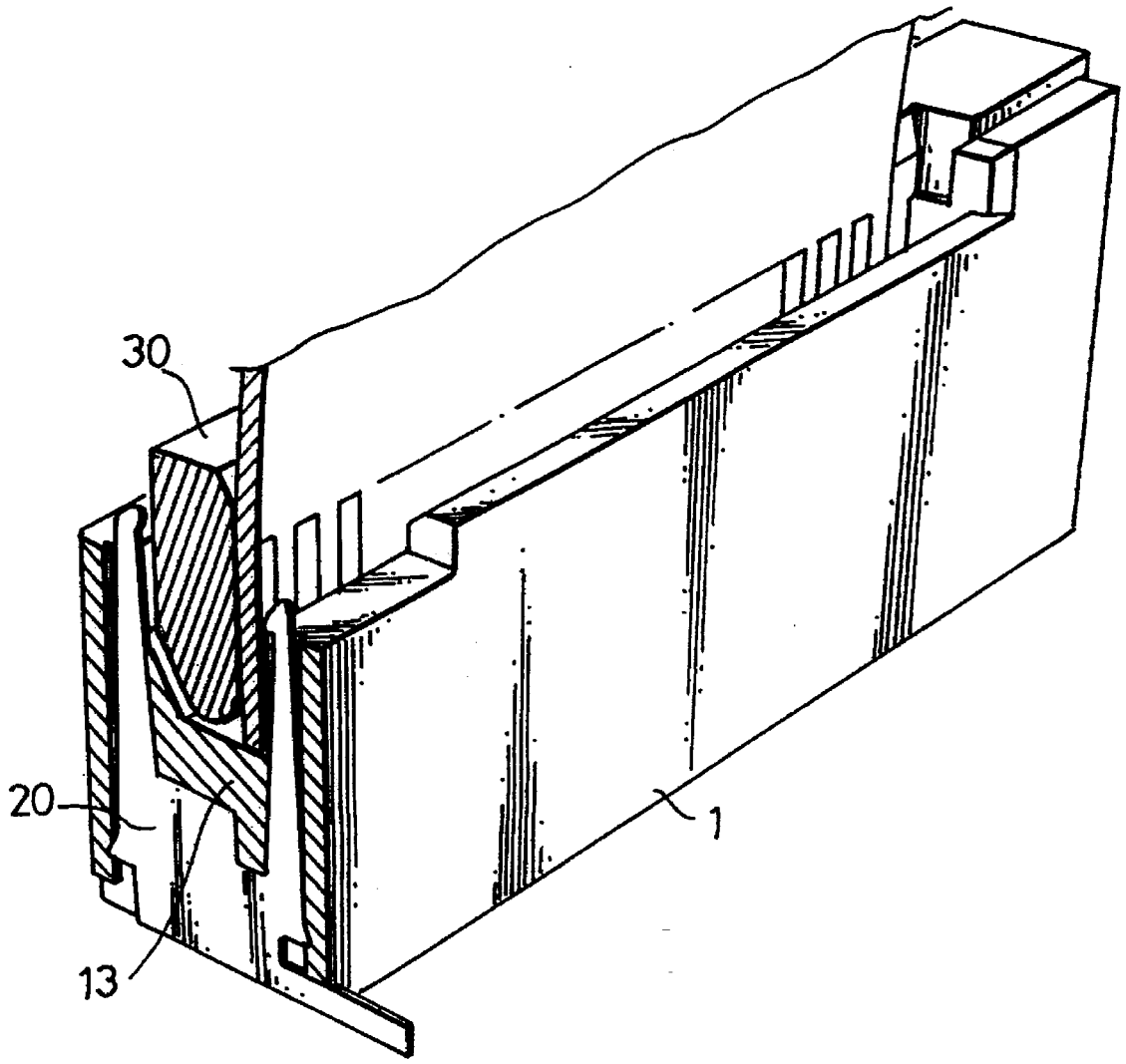
FIG. 6 is a cross-sectional view of the electrical connector of FIG. 1 with an FPC therein to show the final connection status between the connector and the FPC.

With the insertion of the driver means 3 and the FPC into the chamber 11, the arms 201 and 202 of the terminal members 2 are forced to elastically bent outward with the help of the gaps 5 between the arms 201, 202 and the side sections of the slots 12 together with the notches 203 of the terminal members 2, to allow the driver means 3 and the FPC to be moved inward in a less abraded manner. Thereafter, once the ribs 41 of the driver means 3 pass over the strips 40 of the casing 1, the driver means 3 and the FPC are securely retained within the chamber 11 of the casing 1 with the arms 201 and/or 202 in physical and thus electrical contact with corresponding terminals formed on the FPC to establish electrical connection therebetween and also serving to pinch and retain the FPC within the chamber 11, as shown in FIG. 6.

In assembly, as mentioned above, the observation window 14 provide a way to check if the terminal members 2 are correctly located.

Figure 5:
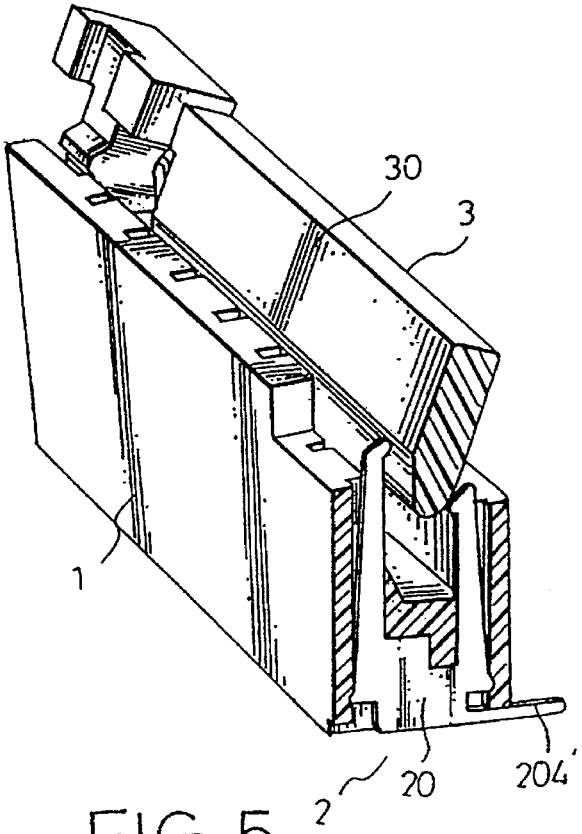
FIG. 5 is a perspective view of an electrical connector constructed in accordance with a second embodiment of the present invention, a portion of the electrical connector being cut off to show the inside structure thereof.

In FIG. 5, a second embodiment of the present invention is illustrated, in which an external contact pin 204' is provided on each of the terminal members 2, similar to the external contact pins 204 shown in FIGS. 1A and 3, but extending from the base 20 of the terminal member 2 in a direction substantially transverse to the arms 201 and 202 to partially project out of the casing 1. The external contact pin 204' provides means for soldering to an external device (not shown).

The important feature of the invention is to provide mechanism for implementation of a rotation/sliding insertion or loading of the driver means 3 with regard to the casing 1. Because the initial insertion of the plate 30 of the driver means 3 is disposed at an angle with regard to the casing 1 (as shown in FIG. 5), a sufficiently large space may be obtained therebetween to allow an FPC to be positioned between the plate 30 of the driver means 3 and the side wall 110 of the casing 1 without interference occurring thereto. This is of a zero insertion type for preventing the excessive abrasion of the FPC occurring in most conventional FPC connectors. It can be understood that the conventional FPC connectors have linear insertion of the corresponding FPC and then it is impossible at the beginning stage to obtain a sufficiently large space between the side wall of the casing and the plate of the driver means to freely sandwich the FPC therebetween because the plate of the driver means has to tightly push the side wall of the casing for assuring the reliable engagement between the FPC and the terminal members of the connector. This is an inherent disadvantage of the conventional linear insertion FPC connectors.

Then, the plate 30 of the driver means 3 successively moves downward and rotatively by means that the camming cylinders 311 guidably move along the inclined edges 132 of the chutes 13 until the rigs 41 slide over the strips 40. AT this final stage, the plate 30 of the driver means 3 is generally in a vertical position in compliance with the chamber 11 and tightly pushes the FPC against the corresponding contact projections 2011 of the arms 201 of the terminal members 2. During this rotation/sliding process, a general downward force is imposed on the driver means 3 to overcome the components of the bending moment due to the resisting terminal members 2, thus naturally resulting in guiding movement the camming cylinders 311 along the inclined edges 132 of the chutes 13.

It can be noted that, to correspond to angular insertion of the plate 30 of the driver means 3, the side wall 110 positioned on the same side of the inclined edge 132 is substantially lower than the other opposite side wall. Correspondingly, the arm 202 of the terminal member 2 within the lower side wall 110 is lower than the arm 201 thereof in the higher side wall 110. Furthermore, as shown in FIG. 5, a tapered surface 33 is formed at the bottom end of the plate 30 to cooperate with a corresponding tapered surface 13 is formed adjacent the bottom portion of the chamber 11 for guiding the plate 30 of the driver means 3 to its final vertical position.

It is apparent that although the invention has been described in connection with the preferred embodiments, it is contemplated that those skilled in the art may make changes to the preferred embodiments without departing from the scope of the invention as defined in the appended claims.

What is claimed is:

1. An electrical connector adapted to be used with a flexible printed circuit, comprising:

an insulation casing, having an interior chamber defined by two generally same height side walls and a bottom and having a top opening, a plurality of slots being formed inside the chamber, having a bottom section extending completely through the bottom and two side sections each partially into each of the side walls, the casing having two opposite lengthwise ends on each of which a chute is formed to have a converging section defined by an inclined edge terminating at a location close to the top opening;

a plurality of conductive terminal members, each comprising a base received within the bottom section of each of the slots and two opposite arms extending from the base along substantially the same direction to be at least partially received within the side sections of the slot, each of the arms having an inclined outer edge that faces a bottom of the respective side section of the slot to define a gap between the arm and the side section of the slot so as to provide a resiliency to the arm to allow the arm to be bent toward the bottom of the side section of the slot and away from each other;

driver means comprising a plate receivable within the chamber of the casing and defining a gap with the side walls of the casing adapted to receive the flexible printed circuit, the driver means having two opposite lengthwise ends, corresponding to the lengthwise ends of the casing, each having an end member mounted thereto, each of the end members having an inward-projected camming cylinder directing toward each other to be received within the respective chute to be guided thereby so as to allow the driver means to be both rotatable and slidably moved up and down relative to the casing.

2. The electrical connector as claimed in claim 1, wherein each of the terminal members having an external contact pin extending from the base thereof to be partially out of the casing.

3. The electrical connector as claimed in claim 2, wherein the external contact pin extends in a direction substantially opposite to the arms of the terminal member.

4. The electrical connector as claimed in claim 2, wherein the external contact pin extends from the base in a direction substantially transverse to the arms of the terminal member.

5. The electrical connector as claimed in claim 1, further comprising means for securing the plate of the driver means within the chamber of the casing.

6. The electrical connector as claimed in claim 5, wherein the securing means comprises strips formed inside the chamber and extending along the lengthwise direction and ribs formed on the driver means to engage the strips with the strips serving as stops to prevent the driver means from moving out of the chamber.

7. The electrical connector as claimed in claim 1, wherein a notch is formed on top side of one of the side walls of the chamber to serve as an observation window for observing positioning of the terminal members.

8. The electrical connector as claimed in claim 1, wherein each of the arms of each of the terminal members has an inward projections which comprise an inclined edge for guiding the insertion of the FPC into the chamber.

9. The electrical connector as claimed in claim 1, wherein each of terminal members has a notch formed on connection of each of the arms to the base to allow the arms to be bent outward away from each other.

10. The electrical connector as claimed in claim 1, wherein each of the terminal members comprises paw portions formed thereon to engage the side walls of the casing for securely retaining the terminal members within the chamber.

11. The electrical connector as claimed in claim 1, wherein the plate of the driver means comprises a lower end having a converging cross section.

12. An electrical connector adapted to be used with flexible printed circuit, comprising:

an insulation casing having an interior chamber with an opening;

a plurality of conductive terminal members retained in the casing and communicative with the chamber;

driver means having a plate to be inserted into the chamber of the casing through the opening and defining a gap for receiving therein the flexible printed circuit;

wherein the casing comprises at least a chute formed on one of two opposite ends of the casing, the chute comprising a converging section defined by an inclined edge terminating adjacent to the opening of the chamber, the driver means having at least an end member formed on one of two opposite ends of the driver means, said end member having a cylinder formed thereon to be received therein the chute of the casing and guided by the inclined edge of the respective chute to allow the plate of the driver means to be rotatable and slidably movable from top to bottom relative to the chamber of the casing.

13. An electrical connector for use with a flexible printed circuit, comprising:

a casing including an interior chamber, said chamber being defined by two generally same height opposite side walls and a bottom, and having a top opening;

a plurality of terminal members positioned within the casing;

driver means including a plate adapted to be received within the chamber wherein said plate is inserted into the chamber adjacent said top opening in a first angle position to leave a sufficiently large space between said plate and the corresponding side wall for freely receiving therein the flexible printed circuit thereby initiating a zero insertion operation, and said plate is successively moved both slidably along a direction from the top opening to the bottom and rotatably with regard to the casing toward the bottom of the casing until said driver means is secured to said casing and said plate is received within the chamber in a second vertical position with regard to the casing.

14. The electrical connector as claimed in claim 13, wherein said driver means includes at least a camming means adapted to be moved along an inclined edge formed on the casing for guidance of both rotation and sliding movements of the driver means with regard to the casing.

15. The electrical connector as claimed in claim 14, wherein opposite to the inclined edge of the casing, a first tapered surface is formed on a bottom portion of the chamber in the casing for compliance with a corresponding second tapered surface on a bottom section of the plate of the driver means.

16. The electrical connector as claimed in claim 13, wherein one side wall is substantially lower than the other one.

* * * * *